US008012066B1

(12) United States Patent
Hsiang

(10) Patent No.: US 8,012,066 B1
(45) Date of Patent: Sep. 6, 2011

(54) WIRE TRAMPOLINE ENCLOSURE

(76) Inventor: Hua-Lu Hsiang, Dong Guan (CN)

( * ) Notice: Subject to any disclaimer, the term of this patent is extended or adjusted under 35 U.S.C. 154(b) by 0 days.

(21) Appl. No.: 12/749,963

(22) Filed: Mar. 30, 2010

(51) Int. Cl.
*A63B 21/00* (2006.01)

(52) U.S. Cl. ..... 482/27; 482/28

(58) Field of Classification Search ..... 482/27, 482/28
See application file for complete search history.

(56) References Cited

U.S. PATENT DOCUMENTS 4,433,838 A * 2/1984 Gordon ..... 473/473
4,452,444 A * 6/1984 Schulze, Jr. ..... 482/27
2007/0021272 A1* 1/2007 Slade ..... 482/27
2008/0090704 A1* 4/2008 Denis et al. ..... 482/28
* cited by examiner

*Primary Examiner* — Jerome w Donnelly
(74) *Attorney, Agent, or Firm* — Clement Cheng

(57) ABSTRACT

A trampoline has an enclosure which includes a wire ring; a plurality of connectors connected to the wire ring; and a plurality of support poles. The support poles have a top end. The support poles have a top bend that bends inward at the top end. The wire ring is substantially inflexible during trampoline use. The trampoline also includes trampoline frame. The plurality of support poles are rigidly connected to the trampoline frame. A trampoline enclosure net is suspended from the wire ring at an upper portion of the trampoline enclosure net. A trampoline mat is included and the trampoline enclosure net is bounded by the trampoline mat at a lower portion of the trampoline enclosure net. A bounding surface is supported by a plurality of springs connecting between the bounding surface and the trampoline frame.

6 Claims, 8 Drawing Sheets

WIRE TRAMPOLINE ENCLOSURE

DISCUSSION OF RELATED ART

Trampolines have been in use for decades as popular backyard entertainment, as well as for Olympic sport. Trampolines generally include a bounding surface, a plurality of springs connecting with the bounding surface to the trampoline frame. Additionally, a plurality of legs extend from the trampling frame to support the trampoline frame above the ground.

The trampoline has become safer with the advent of the trampoline enclosure. A variety of trampoline enclosure structures have been devised for securing users within a safe area. In Publicover U.S. Pat. No. 6,261,207 issued Jul. 17, 2001, the disclosure of which is incorporated herein by reference, a trampoline enclosure has a support system of independent poles extending from the legs of the trampoline. Publicover improved upon the prior art which had substantially inflexible poles connected as he frame above the trampoline frame structure. The prior art included rope webbing for retaining users within the safe area.

Subsequently, Samuel Chen invented in U.S. Pat. No. 6,679,881 issued Jul. 20, 2004, the disclosure of which is incorporated herein by reference, an air and closure trampling safety system relying upon inflatable means for enclosure. Nichols entitled Trampoline Enclosure System in U.S. Pat. No. 6,607,468 issued Aug. 19, 2003, the disclosure of which is incorporated herein by reference, utilized a different method of attaching the enclosure net to poles by means of loops. While the prior art provides a number of configurations, all have certain advantages and disadvantages.

SUMMARY OF THE INVENTION

A trampoline has an enclosure which includes a wire ring; a plurality of connectors connected to the wire ring; and a plurality of support poles. The support poles have a top end. The support poles have a top bend that bends inward at the top end. The wire ring is substantially inflexible during trampoline use. The trampoline also includes trampoline frame. The plurality of support poles are rigidly connected to the trampoline frame. A trampoline enclosure net is suspended from the wire ring at an upper portion of the trampoline enclosure net. A trampoline mat is included and the trampoline enclosure net is bounded by the trampoline mat at a lower portion of the trampoline enclosure net. A bounding surface is supported by a plurality of springs connecting between the bounding surface and the trampoline frame, and the trampoline mat fits over the plurality of springs. A plurality of legs secured to the trampoline frame, and supporting the trampoline frame above the ground. The wire ring is approximately the same diameter as the bounding surface of the trampoline. The trampoline enclosure net is secured to an interior circumference of the trampoline mat. A vertical wire slot is formed on the plurality of connectors.

The trampoline optionally includes a horizontal wire slot communicating with the vertical wire slot, so that the horizontal wire slot is sized to receive the wire ring. A wire ring cover is preferably formed as a sleeve sliding over the wire ring. The support pole is preferably hollow. A plurality of legs extend from plurality of support poles. The legs are U-shaped and formed in sections, namely: a first leg section, a second leg section and a bottom section. The leg connection member connects to the leg first section at a first leg connection interface and connects to the leg second section at a second leg connection interface. The first leg section connects to the support pole and the second leg section connects to the trampoline frame.

Figure 1:
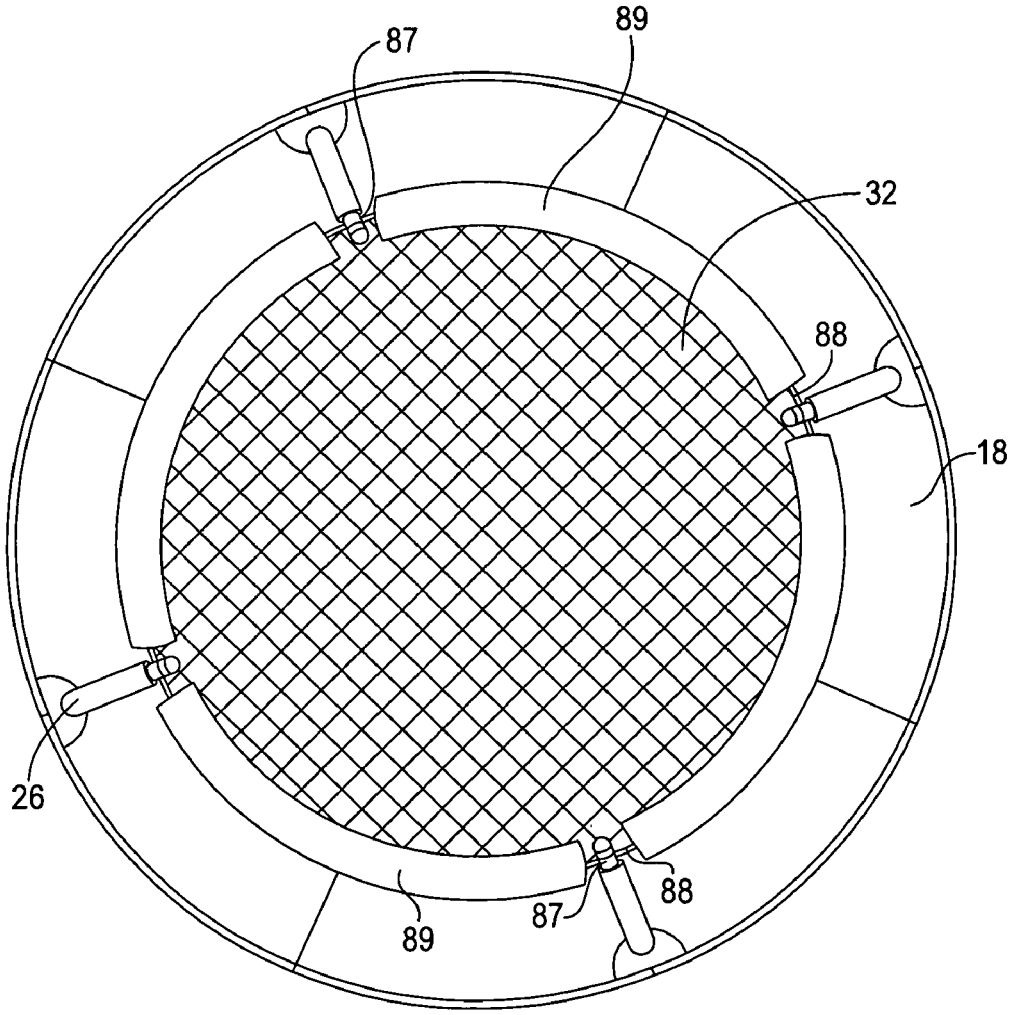
FIG. 1 is a top view of the trampoline.
Figure 2:
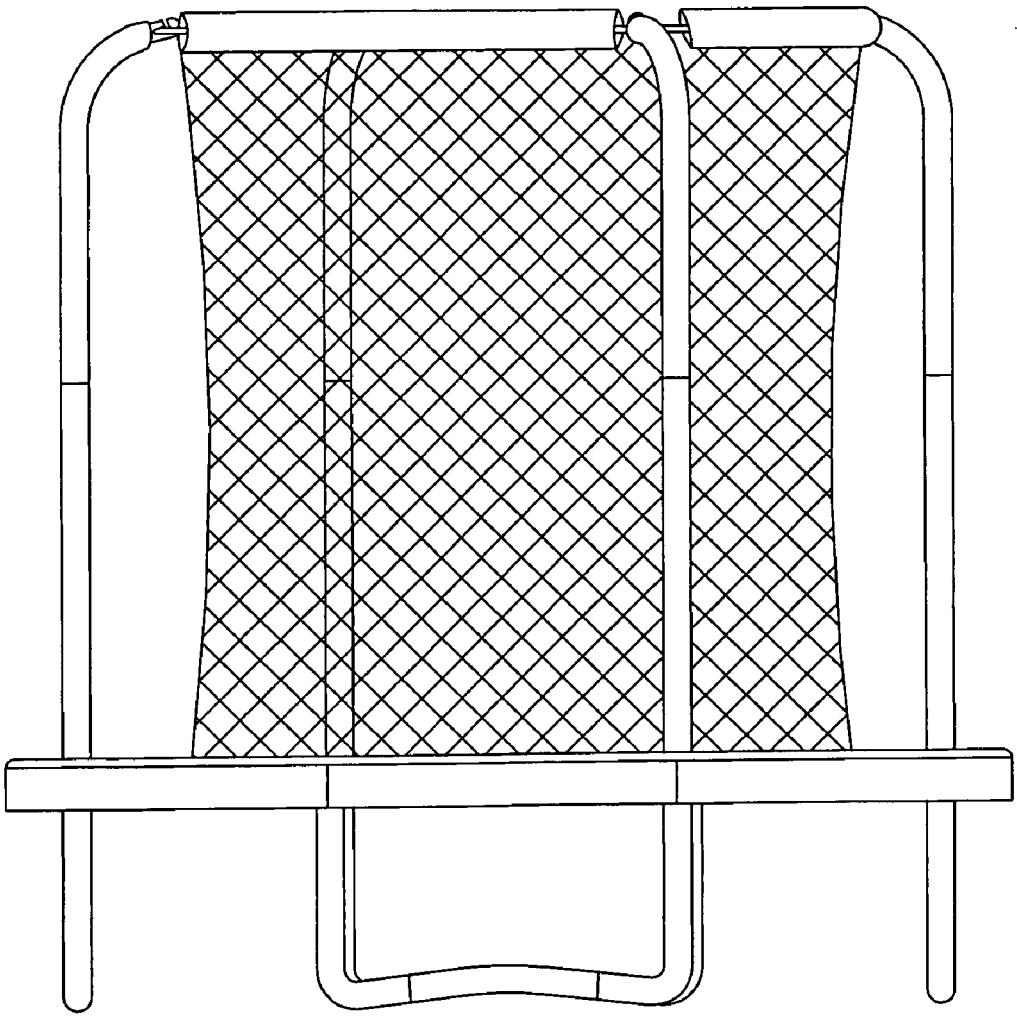
FIG. 2 is a left side view.
Figure 3:
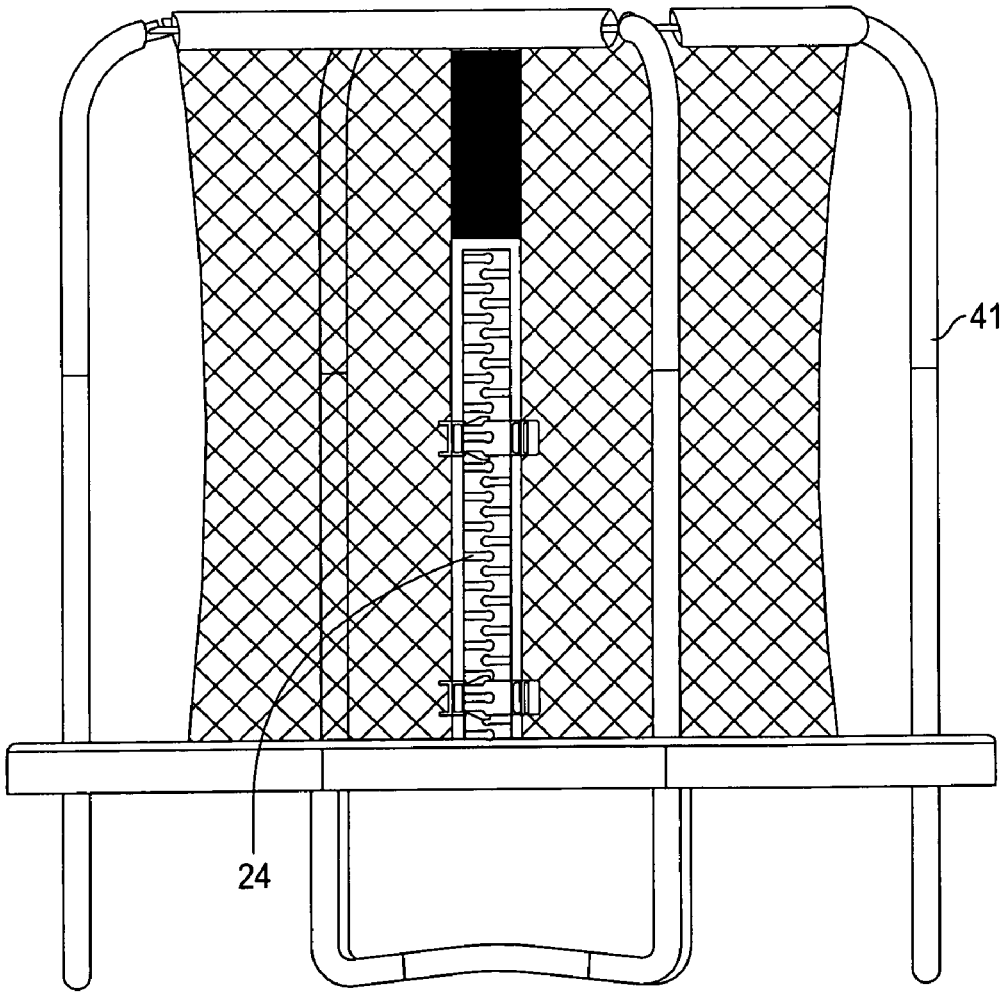
FIG. 3 is a front view showing the entrance.
Figure 4:
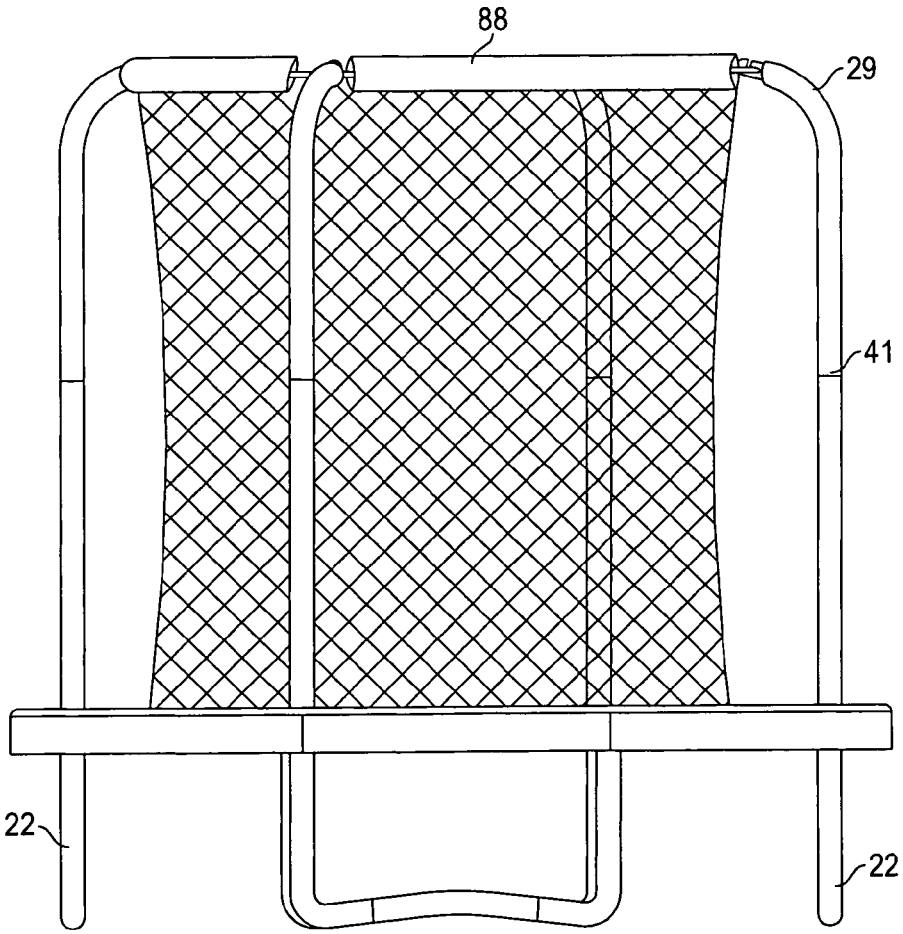
FIG. 4 is a right side view.
Figure 5:
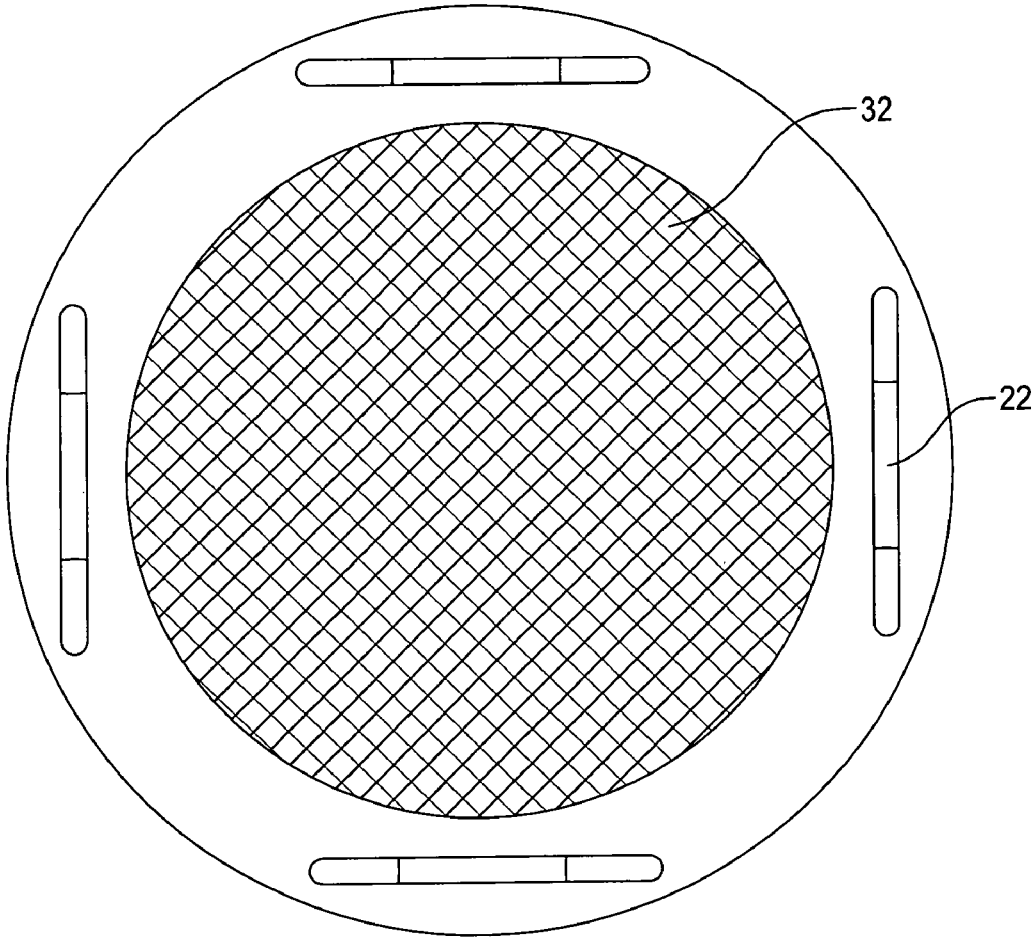
FIG. 5 is a bottom view.
Figure 6:
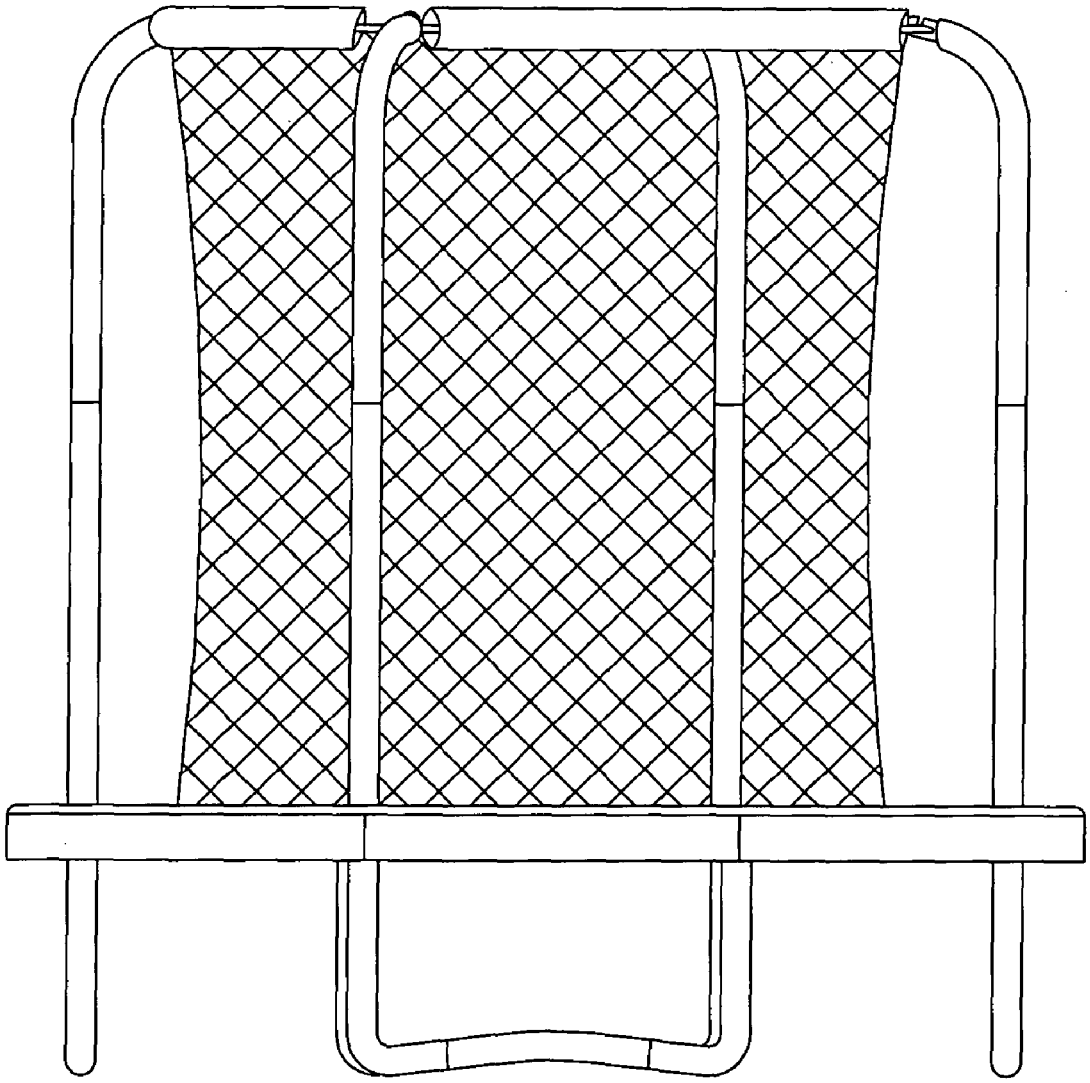
FIG. 6 is a back view.
Figure 7:
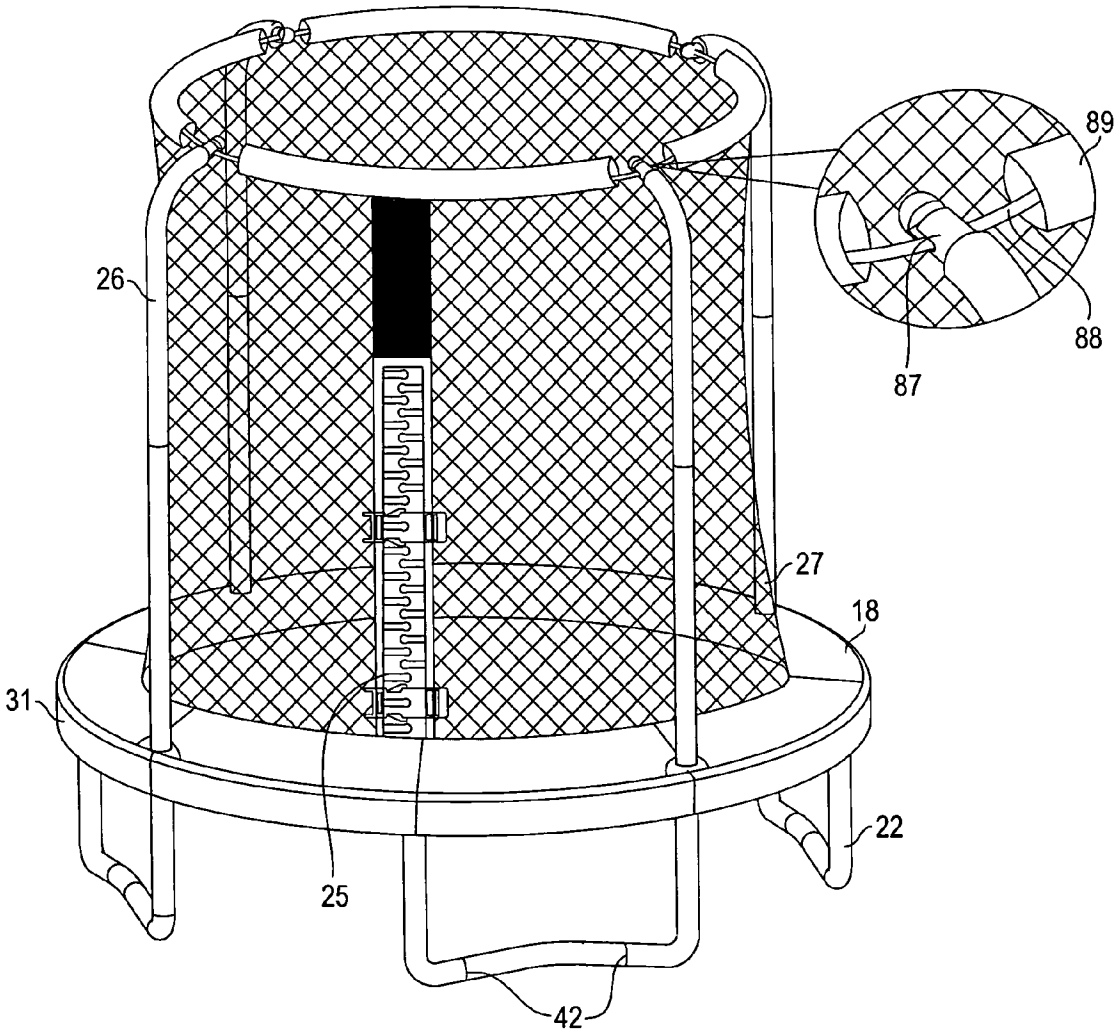
FIG. 7 is a perspective view.

The following call out list of elements is used consistently in the drawings as follows:

18 Mat
22 Legs
24 Entrance
25 Zipper
26 Support Pole
27 Net
29 Pole Bend
31 Trampoline Frame
32 Bounding Surface
41 First Pole Connection
42 Leg Connection
43 Vertical Wire Slot
44 Horizontal Wire Slot
87 Connector
88 Wire Ring
89 Wire Ring Cover

DETAILED DESCRIPTION OF THE PREFERRED EMBODIMENT

The key feature of this invention is the wire ring 88 which is rigid enough to connect connectors 87 such that the tops of the support poles 26 at the pole bend 29 are substantially inflexible. The wire has a gauge cross-section which could be one quarter of an inch in diameter or 4 mm. The wire is preferably a solid length of steel having a circular cross-section and forming a circular profile above a pole bend 29. The wire ring 88 is preferably approximately the same diameter as the bounding surface 32 of the trampoline. The wire ring 88 fits into a vertical wire slot 43 which faces up. The vertical wire slot 43 communicates with a horizontal wire slot 44. The horizontal wire slot 44 receives the wire ring 88. The connector 87 can be welded or screwed onto to the top portion of the support pole. The wire ring 88 has a wire ring cover 89. The wire ring cover 89 can be formed as a sleeve sliding over the wire 88. The support pole is preferably hollow. The support pole 26 is preferably made of an upper section having a bend fitting over a lower section at a first pole connection 41. A total of four support poles 26 can support a wire ring 88 above the bounding surface to define a jumping area enclosed by the trampoline enclosure.

The trampoline enclosure is typically a net having an entrance 24. The entrance can be secured by a zipper 25. The trampoline also has a trampoline mat 18 extending around a circumferential area of the bounding surface. The trampoline mat 18 covers the springs which are not accessible by a user within the jumping area, because the jumping area is limited to the area above bounding surface. A plurality of legs extend from the support pole 26. The legs 22 can be U-shaped and formed in sections, namely a first leg section, a second leg section and a bottom section that is also called a leg connection member. The leg connection member connects to the leg first section at a leg connection interface 42 and connects to the leg second section at a leg connection interface 42. The first leg section is the leg section that connects to the support pole 26. The second leg section connects to the trampoline frame 31.

The trampoline frame 31 supports the mat 18 and the bounding surface, and the springs extending between the bounding surface and the mat. The springs are hidden under the mat. When in use, a user exerts force on the structure. A neutral force position can be defined when a user is absent and the structure is not in use. The structure may have a color scheme where the vertical support and leg is one color and the remainder of the enclosure structure is a different color in which case four J shaped support pole profiles can be seen, connected by a ring at the top.

Figure 8:
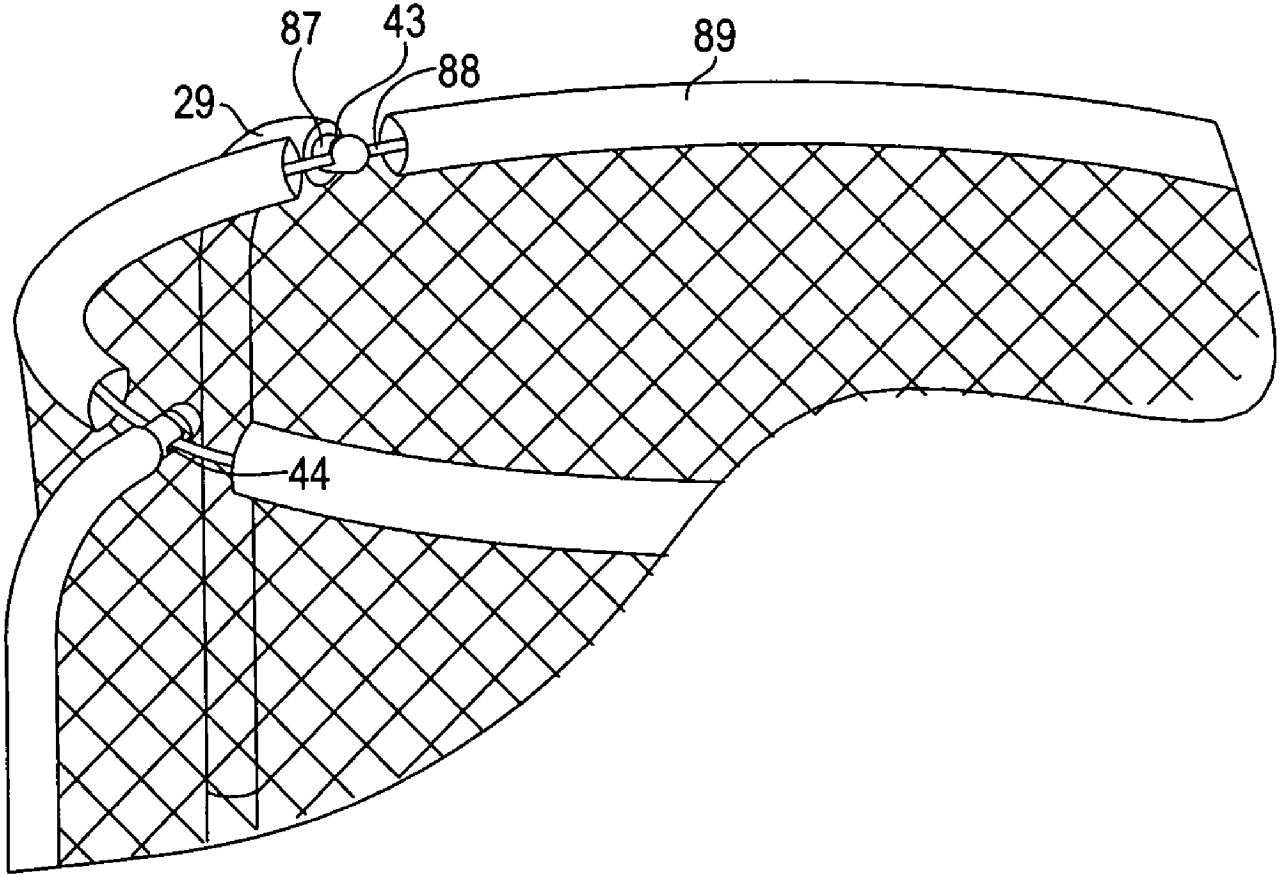
FIG. 8 is a detail view.

During use, a user jumps up and down on the bounding surface 32. The bounding surface extends inward and creates moment and exerts force on the trampoline structure. If the support pole 26 is pressed inward by user mass, the wire ring 88 extends inward along the horizontal wire slot 44 and abuts a base of the wire slot 44. The horizontal wire slot has an angle and is not perfectly horizontal just like the vertical wire slot is not perfectly vertical and also has an angle. As shown in FIG. 8, the horizontal wire slot appears to be angled at approximately 15° from the ground assuming that the ground is flat. The vertical wire slot is preferably perpendicular to the horizontal wire slot. The wire ring 88 may have a neutral force position where the wire ring 88 rests against a base of the wire slot 44.

The wire ring can be formed of sections of wire of approximately ¼" or more, sufficient for maintaining substantially inflexible response of the tops of the support pole 26. The wire ring is preferably substantially rigid enough to maintain a circular shape during use. Optionally, the intermediate portions of the enclosure net 27 can be loop connected to the first loop connection 41 to provide a greater interior jumping area inside the trampoline enclosure. Optionally, the connector can be made as an aluminum milled cap fitting over the support pole and being secured by one or more set screw, or secured by other means.

The sleeve of the enclosure net 27 is preferably folded and sewn over so that the terminal portion of the enclosure net is retained with the sleeve for structural stability. It is preferred that the wire ring have a compressive resistance pushing out against the base of the horizontal wire slot. The base of the horizontal wire slot is the point where the wire ring abuts the horizontal wire slot.

The invention claimed is:

1. A trampoline having an enclosure comprising:

a. a wire ring;

b. a plurality of connectors connected to the wire ring;

c. a plurality of support poles, wherein the support poles have a top end, wherein the support poles have a top bend that bends inward at the top end, wherein the wire ring is substantially inflexible during trampoline use;

d. a trampoline frame, wherein the plurality of support poles are rigidly connected to the trampoline frame;

e. a trampoline enclosure net suspended from the wire ring at an upper portion of the trampoline enclosure net, f. a trampoline mat, wherein the trampoline enclosure net is bounded by the trampoline mat at a lower portion of the trampoline enclosure net;

g. a bounding surface supported by a plurality of springs connecting between the bounding surface and the trampoline frame, wherein the trampoline mat fits over the plurality of springs; and h. a plurality of legs secured to the trampoline frame, and supporting the trampoline frame above the ground, wherein the trampoline enclosure net is secured to an interior circumference of the trampoline mat.

2. A trampoline having an enclosure comprising:

a. a wire ring;

b. a plurality of connectors connected to the wire ring;

c. a plurality of support poles, wherein the support poles have a top end, wherein the support poles have a top bend that bends inward at the top end, wherein the wire ring is substantially inflexible during trampoline use;

d. a trampoline frame, wherein the plurality of support poles are rigidly connected to the trampoline frame;

e. a trampoline enclosure net suspended from the wire ring at an upper portion of the trampoline enclosure net, f. a trampoline mat, wherein the trampoline enclosure net is bounded by the trampoline mat at a lower portion of the trampoline enclosure net;

g. a bounding surface supported by a plurality of springs connecting between the bounding surface and the trampoline frame, wherein the trampoline mat fits over the plurality of springs; and h. a plurality of legs secured to the trampoline frame, and supporting the trampoline frame above the ground, further comprising: a vertical wire slot formed on the plurality of connectors.

3. The trampoline of claim 2, further comprising: a horizontal wire slot communicating with the vertical wire slot, wherein the horizontal wire slot is sized to receive the wire ring.

4. The trampoline of claim 1, wherein the plurality of legs extend from plurality of support poles, wherein the legs are U-shaped and formed in sections, namely: a first leg section, a second leg section and a bottom section; wherein the leg connection member connects to the leg first section at a first leg connection interface and connects to the leg second section at a second leg connection interface, wherein the first leg section connects to the support pole and the second leg section connects to the trampoline frame.

5. The trampoline of claim 2, wherein the plurality of legs extend from plurality of support poles, wherein the legs are U-shaped and formed in sections, namely: a first leg section, a second leg section and a bottom section; wherein the leg connection member connects to the leg first section at a first leg connection interface and connects to the leg second section at a second leg connection interface, wherein the first leg section connects to the support pole and the second leg section connects to the trampoline frame.

6. The trampoline of claim 5, wherein the wire ring is approximately the same diameter as the bounding surface of the trampoline; further comprising: a wire ring cover, wherein the wire ring cover is formed as a sleeve sliding over the wire ring, wherein the support pole is hollow, wherein the trampoline enclosure net is secured to an interior circumference of the trampoline mat.

* * * * *